United States Patent [19]

Kistner

[11] Patent Number: 4,785,893

[45] Date of Patent: Nov. 22, 1988

[54] BOOM OPERATED DEMOLITION APPARATUS AND METHOD OF BREAKING COMPOSITE MATERIAL

[75] Inventor: David Kistner, Dayton, Ohio

[73] Assignee: Caterpillar Inc., Peoria, Ill.

[21] Appl. No.: 109,361

[22] PCT Filed: Dec. 24, 1986

[86] PCT No.: PCT/US86/02760

§ 371 Date: Dec. 24, 1986

§ 102(e) Date: Dec. 24, 1986

[87] PCT Pub. No.: WO87/05064

PCT Pub. Date: Aug. 27, 1987

Related U.S. Application Data

[63] Continuation-in-part of Ser. No. 831,481, Feb. 20, 1986, abandoned.

[51] Int. Cl.[4] ..... B25D 17/00

[52] U.S. Cl. ..... 173/119; 173/124

[58] Field of Search ..... 173/119, 122, 124, 1, 173/13

[56] References Cited

U.S. PATENT DOCUMENTS

| | | | |
|---|---|---|---|
| 2,844,006 | 7/1958 | Lutz et al. | 61/73 |
| 3,319,724 | 5/1967 | Cunningham | 173/119 |
| 3,358,779 | 12/1967 | Cunningham | 173/119 |
| 3,394,856 | 7/1968 | Mitchell | 227/146 |
| 4,076,081 | 2/1978 | Schnell | 173/137 |

*Primary Examiner*—Donald R. Schran
*Assistant Examiner*—James L. Wolfe
*Attorney, Agent, or Firm*—Calvin E. Glastetter

[57] ABSTRACT

Demolition apparatus which is attached to a movable boom-like member of a machine. The demolition apparatus includes support structure which carries a power plunger and an actuator plunger. The plungers are mounted in adjacent relationship and are movable with respect to the support structure. A compression spring urges the power plunger in a direction from the support structure. The actuator plunger includes a latch device which engages a portion of the power plunger. In operation, the support structure is moved toward a surface to be demolished. The actuator member engages the surface and remains fixed as the support structure continues to move toward the surface. Therefore, as this occurs, there is relative movement between the support structure and the actuator plunger. A latch carried by the actuator plunger engages a part of the power plunger and retains the position of the power plunger with respect to the actuator plunger. Therefore, movement of the support structure toward the surface is opposed by the spring, and compression forces of the spring increase as such movement occurs. As the support structure is moved toward the surface, an abutment member carried by the support structure engages the latch and releases the latch from engagement with the power plunger. Thus, the power plunger is released for rapid movement by the spring, and the power plunger strikes the surface for demolition thereof.

13 Claims, 4 Drawing Sheets

BOOM OPERATED DEMOLITION APPARATUS AND METHOD OF BREAKING COMPOSITE MATERIAL

This is a continuation-in-part of Ser. No. 831,481, filed Feb. 20, 1986, now abandoned.

TECHNICAL FIELD

This invention relates to a method and apparatus for breaking composite material such as cement into a plurality of pieces.

BACKGROUND OF THE INVENTION

Numerous types of apparatus have been devised for breaking surfaces such as concrete or asphalt pavement. Such apparatus may be referred to as demolition apparatus.

Known demolition apparatus are shown in U.S. Pat. Nos. 3,319,724 and 3,358,779. These known demolition apparatus are attached to a boom of an earthmoving machine for support of the apparatus. These known apparatus require a separate motor for operation thereof.

It is an object of this invention to provide demolition apparatus which is adapted to be attached to a boom of an earthmoving machine, but in which the demolition apparatus is operated by movement of the boom, without the use of a separate motor for operation of the demolition apparatus.

It is another object of this invention to provide such demolition apparatus which is capable of applying large forces in consideration of the physical size and weight of the apparatus.

It is another object of this invention to provide such demolition apparatus which can be easily and readily attached to a boom of an earthmoving machine and detached therefrom.

It is another object of this invention to provide such demolition apparatus which can be operated at any desired angle, such as vertical operation for demolition of a pavement and such as horizontal operation for demolition of a wall or the like.

Another object of this invention is to provide such demolition apparatus which can be constructed at relatively low costs and which is long lived.

Other objects and advantages of this invention reside in the construction of parts, the combination thereof, the method of operation and the manner of use, as will become more apparent from the following description.

SUMMARY OF THE INVENTION

Demolition apparatus of this invention is adapted to be attached to a boom or boom arm of any suitable machine, such as an earthmoving machine. The demolition apparatus is operable by movement of the boom of the machine and does not require separate motor means for operation of the demolition apparatus.

The demolition apparatus compresses a housing which is attachable to the boom of a machine. An axially movable power plunger which extends from the housing. A power spring urges the power plunger in a direction from the housing. An axially movable actuator plunger extends from the housing. A latch member is pivotally attached to the actuator plunger and engages a portion of the power plunger and normally maintains the position of tee power plunger with respect to the actuator plunger.

In operation, the housing is moved toward a pavement or wall or the like which is to be demolished. As the housing is moved toward the pavement, the actuator plunger comes into engagement with the surface to be demolished. However, the power plunger is spaced from the surface. As continued movement of the housing toward the pavement surface occurs, the actuator plunger remains in engagement with the pavement, and the latch which is attached to the actuator plunger remains in engagement with the power plunger and maintains the position of the power plunger with respect to the surface. Therefore, continued movement of the housing toward the surface causes the actuator plunger and the power plunger to be positioned upwardly within the housing. Such relative movement between the power plunger and the housing is against the forces of the power spring.

This movement of the housing toward the surface continues until an abutment member comes into engagement with the latch which is attached to the actuator plunger. As the latch comes into engagement with the abutment member, the latch is operated and is released from engagement with the power plunger. When this occurs, the power spring instantaneously and rapidly forces the power plunger to travel into striking engagement with the pavement. The power plunger strikes the pavement with the energy of the power spring.

In another aspect of the invention, a holding pressure is exerted on the first surface of the material in a direction generally toward the second surface of the composite material. The holding pressure is increased to generate tensile forces within the first thickness portion and along the surface of a slab of material to be broken. This increased magnitude holding pressure is maintained on the material while the first surface is impacted in a direction generally toward the second surface at a location spaced from the location of said holding pressure.

BEST MODE FOR CARRYING OUT THE INVENTION

Figure 1:
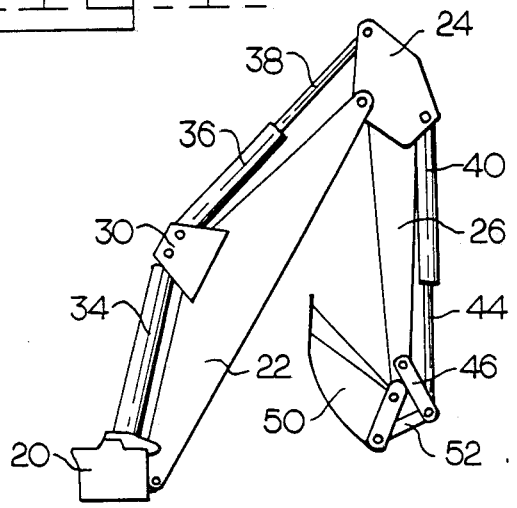
FIG. 1 is a side elevational view of a boom and boom arm of an earthmoving machine, showing a bucket attached to the boom arm for movement and operation with movement of the boom and the boom arm.
Figure 3:
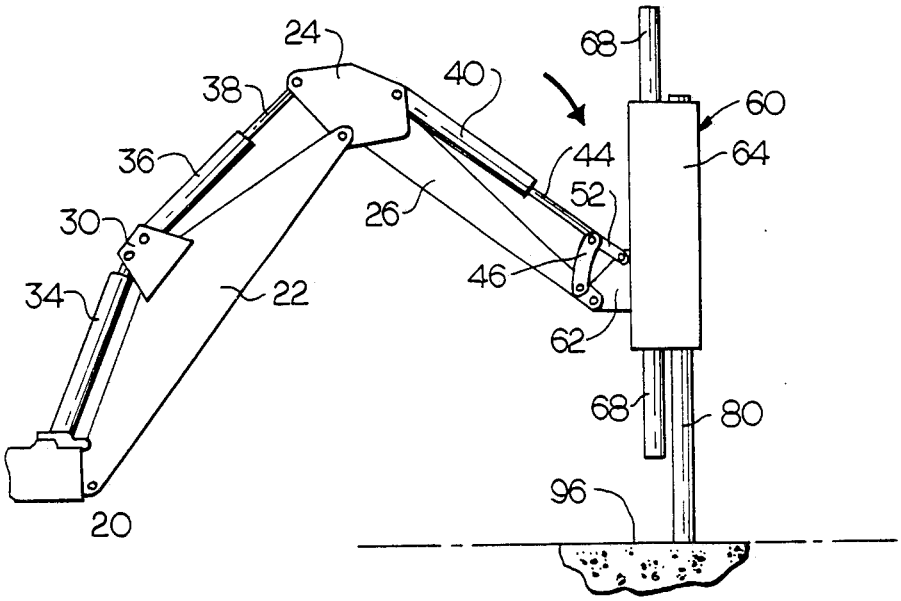
FIG. 3 is a side elevational view showing the boom and the boom arm of FIGS. 1 and 2. This figure shows the actuator plunger of the demolition apparatus in engagement with a pavement surface.
Figure 2:
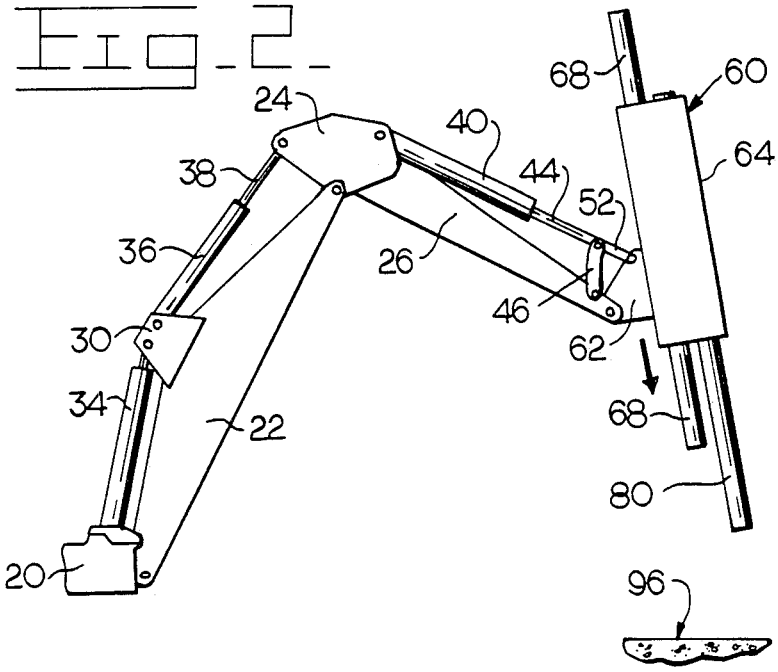
FIG. 2 is a side elevational view showing the demolition apparatus attached to the boom arm, replacing the bucket. The demolition apparatus is shown supported by the boom arm in a position spaced from a pavement to be demolished. In this figure the pavement is shown in section.

FIGS. 1, 2, and 3 show a portion of a machine operation unit 20 which may be a tractor or carrier vehicle or the like, herein shown as an earthmoving machine.

Pivotally attached to the operation unit 20 is a boom 22. Pivotally attached to the boom 22 by means of a connection unit 24 is a boom or force arm 26.

Rigidly attached to the boom 22 intermediate the ends thereof is a connection unit 30. A linearly operable fluid motor 34 is pivotally attached to the operation unit 20 and to the connection unit 30. A linearly operable fluid motor 36 is pivotally attached to the connection unit 30 and has a piston rod 38 extending therefrom. The piston rod 38 is pivotally attached to the connection unit 24.

A linearly operable fluid motor 40 is pivotally attached to the connection unit 24 and has a piston rod 44 extending therefrom. A lever 46 is pivotally attached to the end of the piston rod 44. The lever 46 is also pivotally attached to the arm 26 adjacent the end thereof.

As shown in FIG. 1, the boom arm 26 has a bucket 50 pivotally attached thereto adjacent the end thereof for movement and operation by the operation unit 20. The bucket 50 is also pivotally attached to a link 52. The link 52 is also pivotally attached to the lever 46. The fluid motors 34, 36, and 40 are operated by control means, not shown, carried by the operation unit 20. Thus, the boom 22, the boom arm 26, and the bucket 50 are moved by operation of the operation unit 20.

When it is desired to attach demolition apparatus 60 of this invention to the boom arm 26, the bucket 50 is removed from the arm 26 and from the link 52. The demolition apparatus 60 of this invention includes a housing 64 which is provided with a bracket 62 which is pivotally attached to the end portion of the force arm 26 and to the link 52.

Within the housing 64 is a power plunger 68 which has an end 69. The power plunger 68 is mounted at the opposite ends of the housing 64 and extends from both of the opposite ends of the housing 64. The power plunger 68 is axially movable with respect to the housing 64.

Figure 10:
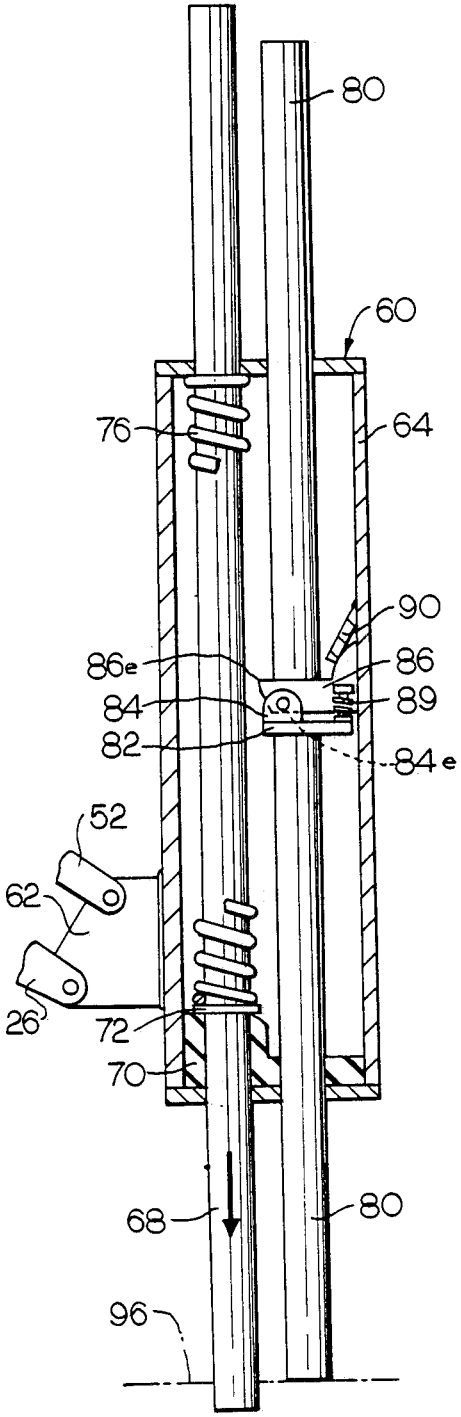
FIG. 10 is a sectional view similar to FIGS. 7 and 8 and illustrating striking action of the power plunger after release thereof.
Figure 7:
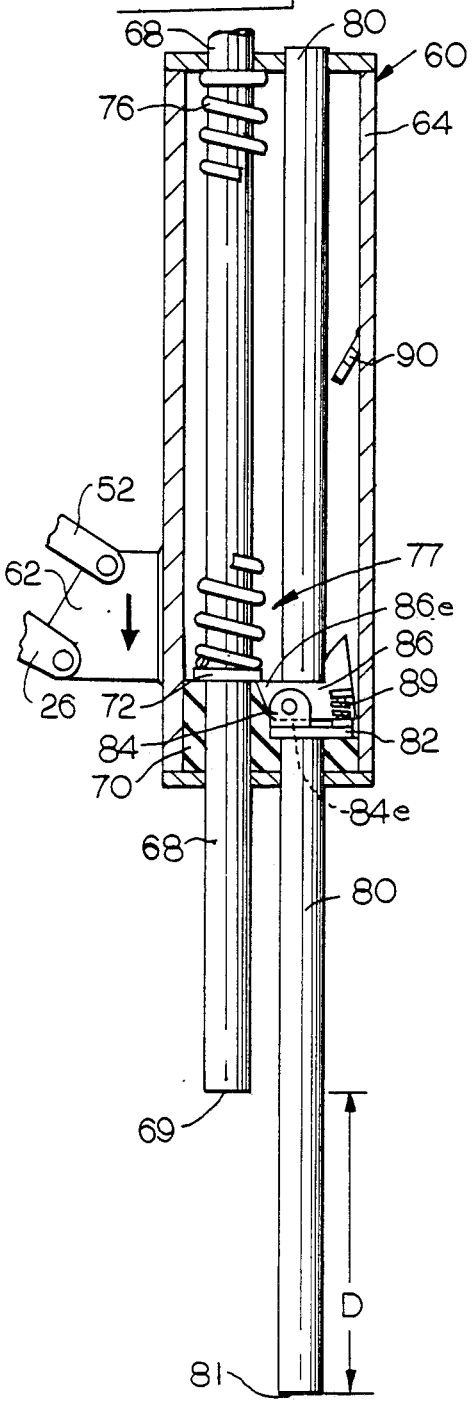
FIG. 7 is an enlarged side sectional view illustrating the position of the plungers of the demolition apparatus as shown in FIGS. 2 and 3, as the demolition apparatus is being moved downwardly toward a surface for definition thereof.
Figure 8:
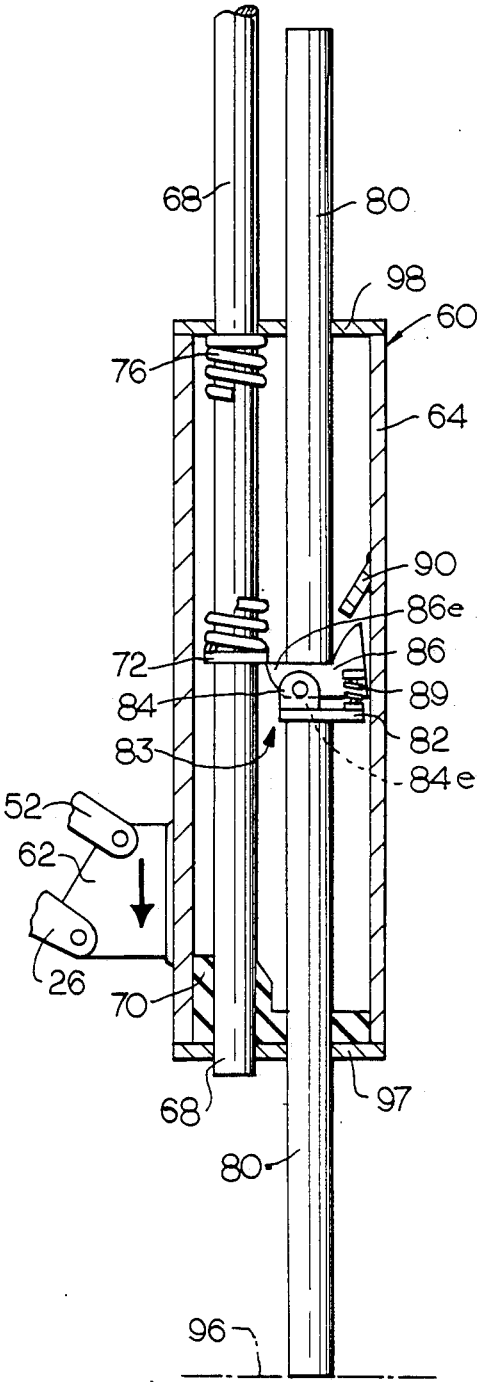
FIG. 8 is an enlarged sectional view similar to FIG. 7 but showing the position of the plungers during further downward movement of the housing and as the actuator plunger engages a surface to be demolished.

As shown in FIGS. 7, 8, and 10, within the housing 64 at the lower end thereof is a cushion 70. The power plunger 68 extends through the cushion 70. Encompassing the power plunger 68 and firmly secured thereto is a collar 72. Compressed between the collar 72 and the upper end of the housing 64 and encompassing the power plunger 68 is a resilient or biasing member preferably in the form of a coil spring 76, for longitudinally biasing the power plunger 68 relative to the housing 64 and in a direction toward said end 69 of the power plunger 68.

Figure 9:
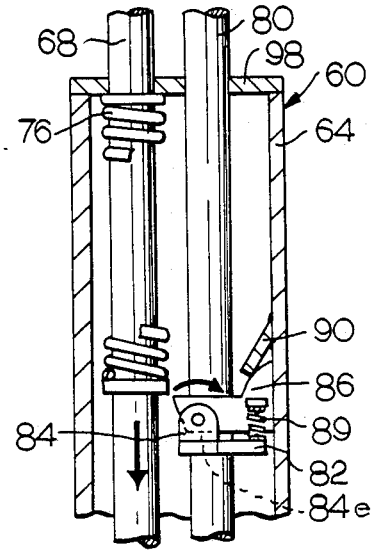
FIG. 9 is a fragmentary sectional view drawn on substantially the same scale as FIGS. 7 and 8, and illustrating the positions of the elements and members of the demolition apparatus at the instant the power plunger is released for downward striking travel toward a surface for demolition thereof.

Also, mounted within the housing 64 is an actuator plunger 80 which has an end 81. The actuator plunger 80 extends from both ends of the housing 64 and extends through the cushion 70. The actuator plunger 80 is axially movable with respect to the housing 64 between a first position (FIG. 7) and a second position (FIGS. 8 and 9). Firmly secured to the actuator plunger 80 intermediate the ends thereof is a base 82. A lug 84 is secured to the base 82. Pivotally attached to the lug 84 and to the actuator plunger 80 is a latch 86. The latch 86 has an engagement portion 86*e* which is positioned adjacent the power plunger 68. A control spring 89 is compressed between the base 82 and the latch 86 and urges pivotal movement of the latch 86 in a counterclockwise direction as viewed in FIGS. 7–10. The lug 84 is provided with a stop portion 84*e* which limits counterclockwise pivotal movement of the latch 86 to the position thereof shown in FIGS. 7 and 8. Fixed within the housing 64, adjacent the actuator plunger 80, is an abutment member 90 which is engageable by the latch 86.

For purposes of clarity, it should be understood that the spring means 77 for longitudinally biasing the power plunger 68 relative to the housing 64 and in a direction toward said end 69 of said power plunger 68 includes the spring 76, collar 72. Further, the means 83 for compressing said spring means 77 in response to moving the actuator plunger 80 from the first toward the second position and releasing said spring means 77 in response to the power plunger 68 having been moved toward the housing 64 a distance greater than said preselected distance (D) includes base 82, lug 84, lug portion 84*e*, latch 86, latch engagement portion 86*e*, coil spring 89, lug stop portion 84*e*, and abutment member 90. It should also be understood that the "trigger" mechanism, which consists of the latch 86, collar 72, and abutment member 90, can be of other construction without departing from this invention.

Industrial Applicability

As stated above and as shown, the demolition apparatus 60 of this invention easily and readily replaces the bucket 50 which is shown attached to the boom arm 26. The bracket 62 of the housing 64 is pivotally attached to the end portion of the boom arm 26 and to the link 52. Movement of the boom 22 and the boom arm 26 thus moves the demolition apparatus.

Figure 5:
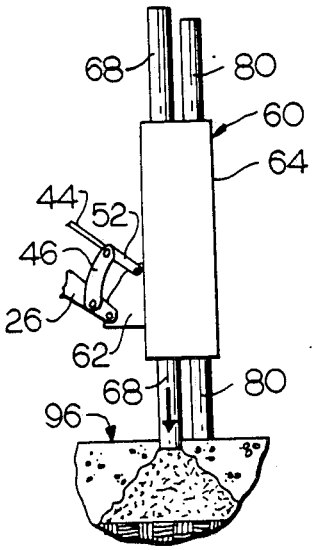
FIG. 5 is a side elevational view, similar to FIG. 4, but illustrating downward striking action of the power plunger.
Figure 6:
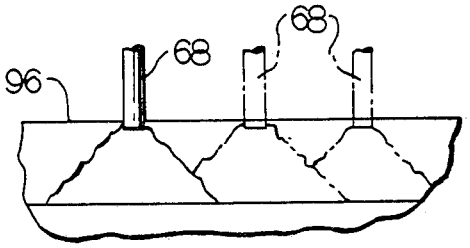
FIG. 6 is a fragmentary sectional view illustrating demolition action created by successive operations of the power plunger of the demolition apparatus.

In a demolition process using the demolition apparatus 60, the boom 22 and the boom arm 26 are operated to move the demolition apparatus 60 toward the surface to be demolished, as illustrated in FIG. 2. The actuator plunger 80 and the power plunger 68 are normally in their maximum extension positions, as shown in FIGS. 2, 3, and 7. In this position, the power plunger 68 is spaced upwardly with respect to the actuator plunger 80. As the boom 22 and the arm 26 move the demolition apparatus 60 downwardly toward a pavement 96, the actuator plunger 80 is brought into engagement with the pavement 96, as illustrated in FIG. 3. The engagement portion 86*e* of the latch 86 which is attached to the actuator plunger 86 is in engagement with the collar 72, which is secured to the power plunger 68. Therefore, as the boom 22 and the arm 26 continue to move the demolition apparatus 60 downwardly, the housing 64 is moved downward but the actuator plunger 80 and the power plunger 68 do not move. Therefore, there is relative movement between the plungers 80 and 68 and the housing 64. This downward movement of the housing 64 is against the compression forces of the spring 76 which encircles the power plunger 68 and which engages the collar 72 and the housing 64. This downward movement of the housing 64 continues until the abutment member 90 within the housing 64 engages the latch 86 which is carried by the actuator plunger 80, as shown in FIG. 9. This is at a location at which the power plunger 68 has been moved toward and relative to the housing 64 a distance greater than preselected distance "D". When this engagement occurs, the latch 86 is pivotally moved against the force of the control spring 89 and becomes disengaged from the collar 72 which is secured to the power plunger 68, as illustrated in FIG. 9. When the latch 86 releases the collar 72, the power spring 76 immediately forces the power plunger 68 downwardly at a high rate and with a significant force, as illustrated in FIGS. 9 and 10. The power plunger 68 strikes the pavement 96 and crushes and breaks the pavement 96, as illustrated in FIGS. 5 and 6. When the power plunger 68 reaches its maximum downward position as illustrated in FIG. 10, the collar 72 engages the cushion 70.

The demolition apparatus 60 is then again raised by the arm 26 and the boom 22, and the demolition apparatus 60 is moved to an adjacent position above the pavement 96. The housing 64 is again moved downwardly for engagement of the actuator plunger 80 with the pavement 96, and the operation is repeated to cause the power plunger 68 to strike the pavement in several adjacent locations. The pavement is broken and demolished, as illustrated in FIG. 6.

Thus, the demolition apparatus of this invention is operated without the use of a special motor for operation thereof. Movement of the boom arm 26 and the boom 22 with respect to the surface to be demolished causes operation of the demolition apparatus 60.

If it is desired to demolish a wall, ceiling, or the like, the boom 22 and the boom arm 26 are operated to change the angle of the housing 64.

Thus, the demolition apparatus 60 can be employed to demolish a surface which is substantially horizontal or a surface which is substantially vertical or a surface having any other angle. However, at some angles it is necessary to employ a return spring on the actuator plunger 80 for ease of operation.

Figure 4:
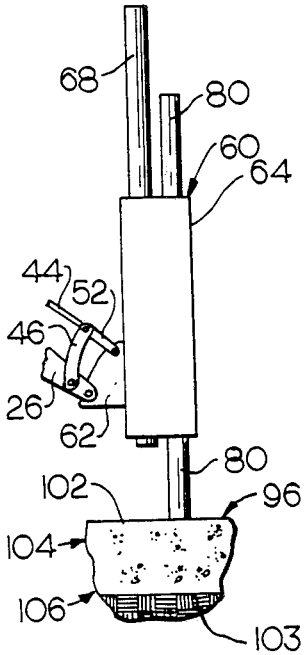
FIG. 4 is a side elevational view showing a portion of the boom arm of the machine, with the demolition apparatus attached thereto and showing the positions of the power plunger and actuator plunger at the instant of release of the power plunger for striking action.

Another aspect of the invention resides in the method of breaking into a plurality of pieces a sheet of pavement or composite material 96 having (as shown in FIGS. 4 and 5) opposed first and second surfaces 102,103, a thickness, a first thickness portion 104 containing said first surface 102, and a second thickness portion 106 containing said second surface 103 and wherein said composite material 96 has greater strength in compression than in tension. An example of such composite material 96 is concrete containing Portland cement.

In the steps of this unique method, a holding pressure is exerted on the first surface of the composite material 96 in a direction generally toward the second surface 103. The holding pressure is then increased to a magnitude sufficient to generate tensile forces within said first thickness portion 104 and along said first surface 102. Thereafter, the increased magnitude holding pressure is maintained while impacting the first surface 102 in a direction generally toward said second surface and at a location spaced from the location of said holding pressure As described above, the holding or concrete bending pressure is exerted by actuator plunger 80 and the impacting force is exerted by power plunger 68.

One skilled in the art will quickly recognize that by exerting the increased holding pressure on the first surface of the concrete, the upper portion of the concrete will be subjected to tensile forces and the lower portion will be subjected to compression forces in response to generating bending forces on the concrete.

It has been discovered that when concrete has such forces imparted and then heavily impacted in the general vicinity of such bending forces, that the concrete will shatter and break into a significantly larger number of pieces to a significantly greater depth and the broken pieces will be of smaller individual sizes than where the composite material is impacted without exerting bending forces upon it. By the method of this invention, the inherent characteristics of concrete and other composite material, both man made and naturally occurring, are utilized to mechanically assist in the demolition process. It has also been observed that upon impact, major breaking lines radially downwardly and outwardly at approximately 45° angles, as shown in FIG. 5, as opposed to more conventional, substantially vertical, cracking that is produced by impacting the unstressed concrete.

The increased magnitude holding or bending pressures exerted on the concrete are naturally a function of the thickness of the concrete desired to be broken. The majority of concrete generally desired to be removed falls within a thickness of 12 inches or less. Preferred increased magnitude holding pressures are therefore in the range of about 600 psi to about 150 psi. This pressure is preferably exerted by a holding element or actuator plunger 80 having an end whose area is greater than about 7 square inches. At pressures below the preferred minimum, the upper surface of the concrete is not sufficiently stressed and breaking is undersirably inefficient and wastes manpower and expense. At pressures greater than the preferred maximum, the concrete is unnecessarily stressed which represents an undesirable waste of manpower and expense. Where the holding element has a surface area less than the preferred range, the concrete first surface is subjected to undesirable shear forces and where the surface is greater than that preferred area, the apparatus wastes material utilized for its construction and requires unnecessary power to move and handle the apparatus.

In breaking concrete, it has also been discovered that the distance between the holding force and the impact force should be greater than one inch and the concrete should be impacted at intervals not less than 5 inches from one another in order to break the concrete efficiently and effectively. At lesser distances apart an undesirable shearing action is produced and at less distances between impacts there is a waste of resources by over fracturing the concrete and/or failing to efficiently utilize the optimum lateral extent of concrete crack propogation.

Although the preferred embodiment of the boom operated demolition apparatus of this invention has been described, it will be understood that within the purview of this invention various changes may be made in the form, details, proportion and arrangement of parts, the combination thereof, and the mode of operation, which generally stated consist in a boom operated demolition apparatus within the scope of the appended claims.

I claim:

1. Demolition apparatus adapted to be carried by a movable boom-like member which moves the demolition apparatus toward and away from a surface to be demolished comprising:

support structure adapted to be attached to a boom-like member;

an axially movable power plunger supported by the support structure for movement with respect to the support structure, a resilient member, means joining the resilient member to the support structure and to the power plunger whereby the resilient member urges the power plunger in a direction from the support structure;

an actuator plunger supported by the support structure adjacent the power plunger and substantially parallel thereto, the actuator plunger and the support structure being relatively movable, a latch attached to the actuator plunger and engageable with a portion of the power plunger to maintain the position of the power plunger with respect to the position of the actuator plunger, the actuator plunger having an extending portion extending from the support structure;

an abutment member attached to the support structure and engageable with the latch with movement of the support structure; and whereby the support structure is movable toward the surface to be demolished as the extending portion of the actuator plunger engages the surface to be demolished, additional movement of the support structure toward the surface forcing relative movement between the support structure and the plungers, such movement being against the forces of the resilient member, additional movement of the support structure toward the surface forcing the abutment member against the latch, whereby the latch is released from engagement with said portion of the power plunger, and the resilient member forces rapid movement of the power plunger which strikes the surface for demolition of the surface.

2. Demolition apparatus adapted to be carried by a movable arm-like member for demolition of a surface comprising:

support structure adapted to be attached to a movable arm-like member, an axially movable power plunger supported by the support structure, a resilient member, means joining the resilient member to the power plunger and to the support structure whereby the resilient member urges the power plunger in a direction from the support structure, an actuator plunger carried by the support structure and having a portion extending therefrom, a latch member supported by the actuator plunger and engageable with a portion of the power plunger to maintain the position of the power plunger with respect to the position of the actuator plunger, release means carried by the support structure for release of the latch member from the power plunger in accordance with the relative positions of the support structure and the actuator plunger, whereby the support structure is adapted to be moved by the arm-like member toward a surface for demolition of the surface, whereby the actuator plunger engages the surface, and additional movement of the support structure toward the surface forces relative movement between the support structure and the plungers, such movement being against the forces of the resilient member, whereby additional movement of the support structure toward the surface operates the release means for release of the latch member from engagement with said portion of the power plunger and releasing the power plunger for rapid travel under the influence of the resilient member and into engagement with the surface for demolition thereof.

3. The demolition apparatus of claim 2 wherein the latch member is pivotally supported by the actuator plunger.

4. The demolition apparatus of claim 2 in which the power plunger includes a collar which is engaged by the latch member.

5. The demolition apparatus of claim 2 in which the support structure includes an attachment bracket which is adapted to be pivotally attached to a movable arm-like member for support thereby.

6. The demolition apparatus of claim 2 in which the release means comprises an abutment member which is engageable with the latch member for operating the latch member for release of the latch member from said portion of the power plunger.

7. The demolition apparatus of claim 2 in which the support structure comprises an elongate housing having a pair of opposed end walls, and in which the actuator plunger is an elongate cylindrical member and extends through both of the opposed end walls, and in which the power plunger is an elongate cylindrical member and is adjacent and parallel to the actuator plunger and extends through both of the opposed end walls.

8. The demolition apparatus of claim 2 in which the support structure comprises an elongate housing having a pair of opposed end walls, and in which the actuator plunger extends through both of the opposed end walls, and in which the power plunger is adjacent the actuator plunger and extends through both of the opposed end walls.

9. Demolition apparatus adapted to be attached to a movable arm of a machine for movement by the movable arm for demolition of a surface, comprising:

support structure;

means for attaching the support structure to a movable arm;

an axially movable power member supported by the support structure, the power member having a strike portion movable from the support structure;

an axially movable actuator member substantially parallel to the power member and supported by the support structure, the actuator member having an engagement portion extending from the support structure;

a spring, means joining the spring to the support structure and to the power member and urging axial movement of the power member in a direction from the support structure;

the actuator member including carrier means engageable with a part of the power member for maintaining the position of the power member with respect to the actuator member; and whereby the support structure is adapted to be supported and moved by an arm toward a surface for demolition of the surface and the engagement portion of the actuator member is moved into engagement with the surface and remains in engagement with the surface, continued movement of the support structure toward the surface being substantially parallel to the axis of the actuator member and opposed by the spring as the actuator member maintains the position of the power member, control means supported by the support structure and operable upon the carrier means to disengage the carrier means from the power member as the support structure is moved to a predetermined position with respect to the actuator member, whereby disengagement of the power member permits the spring to force the power member to move the strike portion thereof against the surface for demolition of the surface.

10. Demolition apparatus comprising an elongate housing provided with a pair of end walls:

an elongate power plunger within the housing and extending through the end walls thereof, the power plunger having an engagement portion, the power plunger also having a strike portion adjacent an end thereof;

an actuator plunger within the housing, substantially parallel to the power plunger and extending through the end walls of the housing;

a latch attached to the actuator plunger and engageable with the engagement portion of the power plunger to maintain the position of the power plunger with respect to the position of the actuator plunger;

a coil spring engaging the housing and the power plunger and urging movement of the power plunger in a direction from the housing;

an abutment member within the housing and engageble with the latch for release of the latch from the engagement portion of the power plunger; and whereby the housing is moved toward a surface to be demolished and the actuator plunger engages the surface and maintains the position of the actuator plunger and the power plunger with the strike portion of the power plunger spaced from the surface, whereby additional movement of the housing toward the surface moves the abutment member into engagement with the latch and releases the latch from the engagement portion of the power plunger and the spring forces movement of the power plunger for engagement of the strike portion of the power plunger with the surface.

11. Apparatus adapted for mounting on a boom arm supported for movement by fluid actuating means, said apparatus comprising a support member, means for connecting the support member to the boom arm, an elongate impact plunger supported by the support member for linear movement relative to the support member and for engaging a surface to be impacted, a spring disposed for biasing the plunger toward the surface, means for preloading the spring in response to movement of the support member by the boom arm toward the surface to develop a substantial preload force within the spring, means for releasing the spring when the support member moves toward the surface to a predetermined limit, and means for exerting the preload force of the spring against the impact plunger when the spring is released.

12. Apparatus adapted for mounting on a boom arm supported for movement in a vertical plane by fluid actuating means, said apparatus comprising a support member, means for connecting the support member to the boom arm, an elongate impact plunger supported by the support member for linear movement relative to the support member and for engaging a surface to be impacted, an elongate actuator plunger supported by the support member for linear movement generally parallel to the impact plunger and adapted to engage the surface, a spring disposed for biasing the impact plunger toward the surface, means on the actuator plunger for preloading the spring relative to the impact plunger in response to movement of the support member by the boom arm toward the surface to develop a substantial preload force within the spring, and means for releasing the spring and the impact plunger in response to movement of the support member to a predetermined limit to drive the impact plunger against the surface with the preload force of the spring.

13. A demolition apparatus adapted to be connected to a force arm and moved into forcible engagement with a composite material for breaking said composite material into a plurality of pieces, comprising:

a housing having an end and being connectable to and movable in response to movement of said force arm;

an actuator plunger having an end and being connected to and axially movable relative to the housing between first and second positions;

a power plunger having an end and being connected to and axially movable relative to the housing in a direction substantially parallel to said actuator plunger in response to movement of said actuator plunger from the first toward the second position, said plunger ends being longitudinally spaced a preselected distance "D" one from the other at the first position of the actuator plunger with said actuator plunger end being spaced the farthest from said housing;

spring means for longitudinally biasing the power plunger relative to the housing and in a direction toward said end of said power plunger; and means for compressing said spring means in response to moving the actuator plunger from the first toward the second position and releasing said spring means in response to the power plunger having been moved relative to and toward the housing a preselected distance greater than said preselected distance.

* * * * *